US005485781A

United States Patent [19]

Rovaris

[11] Patent Number: 5,485,781

[45] Date of Patent: Jan. 23, 1996

[54] APPARATUS AND METHOD FOR SCREEN PRINTING A RIGID OBJECT WITH CLEANING OF THE PRINT SIDE OF THE FRAME

[75] Inventor: Lorenzo Rovaris, Monza, Italy

[73] Assignee: Asco Screen Products S.r.l., Milan, Italy

[21] Appl. No.: 249,804

[22] Filed: May 26, 1994

[30] Foreign Application Priority Data

May 28, 1993 [IT] Italy ..... MI93A1113

[51] Int. Cl.[6] ..... B41F 15/12; B41F 35/00

[52] U.S. Cl. ..... 101/129; 101/123; 101/425

[58] Field of Search ..... 101/114, 123, 101/124, 129, 423, 425; 427/282; 118/70; 15/97.1, 102, 103

[56] References Cited

U.S. PATENT DOCUMENTS

| | | | |
|---|---|---|---|
| 4,268,545 | 5/1981 | Hodulik | 101/129 |
| 4,389,936 | 6/1983 | Jaffa et al. | 101/123 |
| 4,911,074 | 3/1990 | Simila | 101/114 |
| 5,070,782 | 12/1991 | Sakai et al. | 101/123 |
| 5,197,384 | 3/1993 | Yawata et al. | 101/123 |
| 5,271,325 | 12/1993 | Price et al. | 101/423 |

FOREIGN PATENT DOCUMENTS

| | | | |
|---|---|---|---|
| 209158 | 9/1986 | Japan | 101/425 |
| 302046 | 12/1988 | Japan | 101/123 |
| 80250 | 3/1990 | Japan | 101/123 |
| 74381 | 3/1990 | Japan | 101/425 |

*Primary Examiner*—Stephen Funk
*Attorney, Agent, or Firm*—Herbert Dubno

[57] ABSTRACT

The apparatus for screen printing from one edge to the other of an object of a rigid material, beside the conventional components for screen printing, includes a scraper, acting on the lower face of the printing frame, for removing ink from the portion of design that exceeds the perimetric dimensions of the object to be printed. Through the apparatus it is possible to perform a method for screen printing from one edge to the other of an object made of a rigid material, which method consists of printing the design on the object, exceeding the printing on at least one of the edges of the object; spacing the printing frame from the printed object and scraping, from the lower face of the printing frame facing the object, ink which has not been deposited on the object because of the lesser dimensions of the object with respect of the design.

7 Claims, 4 Drawing Sheets

APPARATUS AND METHOD FOR SCREEN PRINTING A RIGID OBJECT WITH CLEANING OF THE PRINT SIDE OF THE FRAME

SPECIFICATION

1. Field of the Invention

The present invention relates to an apparatus and a method for silk-screen, or screen, printing from one edge to the other of an object composed of a rigid material.

2. Background of the Invention

As is known, in screen printing on an object made of a rigid material several variables have to be taken into account if the quality of the printing is not to be poor.

For example, in screen printing on an object it is always necessary to check the standard parameters of the screen printing process such as the screen tension, the compensation of the image deformation, the pressure, stiffness and inclination of the doctor blade and, not least important, the dimensional variation of the film or of the frame due to the variations of the work conditions.

It is even more difficult to obtain good quality screen printing when, as normally happens, the object to be printed is mass produced and its real dimensions, with respect to the nominal design dimensions, vary from one piece to another.

The above problems in printing across the edges of an object, are conventionally solved in a very simple way.

The design to be printed on the object is realized on the printing frame or screen, and is uniformly shrunk by a selected value (one millimeter or more) with respect to the true perimetric dimensions of the object.

In this manner, it is mathematically assured to always print correctly, regardless of the dimensional variations of the object due to the inability to maintain the working tolerances in mass productions, or regardless of the standard parameters based in screen printing.

In other words, after centering the object on the frame, since the design is smaller than the object, its final result is always assured.

The only inconvenience of this printing method is that the printed object has an unprinted small area around the edges. For example, if the rigid object to be printed is a vehicle window pane, the peripheral black print (almost all the car manufacturers adopt this solution) because of the above reasons will not reach the edges of the pane and a peripheral strip will remain unprinted.

Recently, however, in the new automatic systems for assembling the window panes on the vehicles, the pane edges are left exposed and therefore the panes have to be printed from one edge to the other without discontinuity.

For the above reasons, the screen printing on windshields, door windows, rear windows, overhead windows, etc., is performed twice across two edges each time.

It is easily understood however that with this solution there is an area of the pane, or other object, with a double printing and therefore is a product of lower quality.

Furthermore, if all the edges of the object have to be printed, it is necessary to reposition the object on the printing bed with a considerable waste of time.

It is also noted that after printing two edges it is necessary to wait for the object to dry before printing the other two edges, causing a further waste of time and rendering this method extremely costly.

Therefore, this solution does not guarantee a precise and accurate printing and even considerably increases the cost of each produced unit.

OBJECTS OF THE INVENTION

The present invention seeks to eliminate the above drawbacks of the prior art by providing an improved apparatus and method, for screen printing from one edge to the other of an object of rigid material, without any discontinuity, even when the external dimensions of the object to be printed have a negative or positive variation with respect to the nominal dimensions and regardless of the standard parameters used in screen printing, such as the fabric tension, the compensation of the image deformation, the pressure, stiffness and inclination of the doctor blade, the dimensional variations of the film or of the frame due to the working conditions.

An important object of the invention is to provide an apparatus and a method for screen printing from one edge to the other of a rigid material which does not require printing only across two edges at a time, with consequent waste of time, allowing instead to reduce the cost of each produced item and reducing the start up costs.

A further object of the invention is to provide an apparatus and a method for screen printing from one edge to the other of an object of rigid material, which can be used for any type of object to be printed, independently of the object dimensions, or of the centering and feeding systems on the printing bed.

Still another object of the invention is to provide an apparatus and a method for screen printing from one edge to the other of an object of rigid material which is obviously not limited to car window panes but rather allows printing across two edges, without discontinuity, of contoured objects or squared objects such as shower booths, oven doors, furniture glass panes, etc.

SUMMARY OF THE INVENTION

These objects are achieved by an apparatus for screen printing from one edge to the other of an object of rigid material which comprises: a printing bed, a printing frame associated with the printing bed and supporting a design to be printed on the object, a means for distributing ink on the printing frame, means for pressing ink through the design and at least a first means for scraping ink from above the printing frame. The apparatus also comprises second ink scraping means acting on a lower face of the printing frame facing the object for removing ink from a portion of the design which exceeds the perimetric dimensions of the object to be printed. The second scraping means can comprise at least one scraper moving along a path parallel to the path followed by the first scraping means and by the distribution and pressing means.

This apparatus allows screen printing from one edge to the other of an object of rigid material by a process which comprises: arranging a design on a printing frame, all the perimetric dimensions of the design being proportionally greater than the dimensions of the object; centering the object to be printed on a printing bed, printing the design on the object, the ink on the frame passing beyond at least one of the edges of the object, spacing the printing frame from the printed object and scraping, from the lower face of the printing frame facing said object, ink which has not been deposited on the object because of the lesser dimensions of the object with respect of the design.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
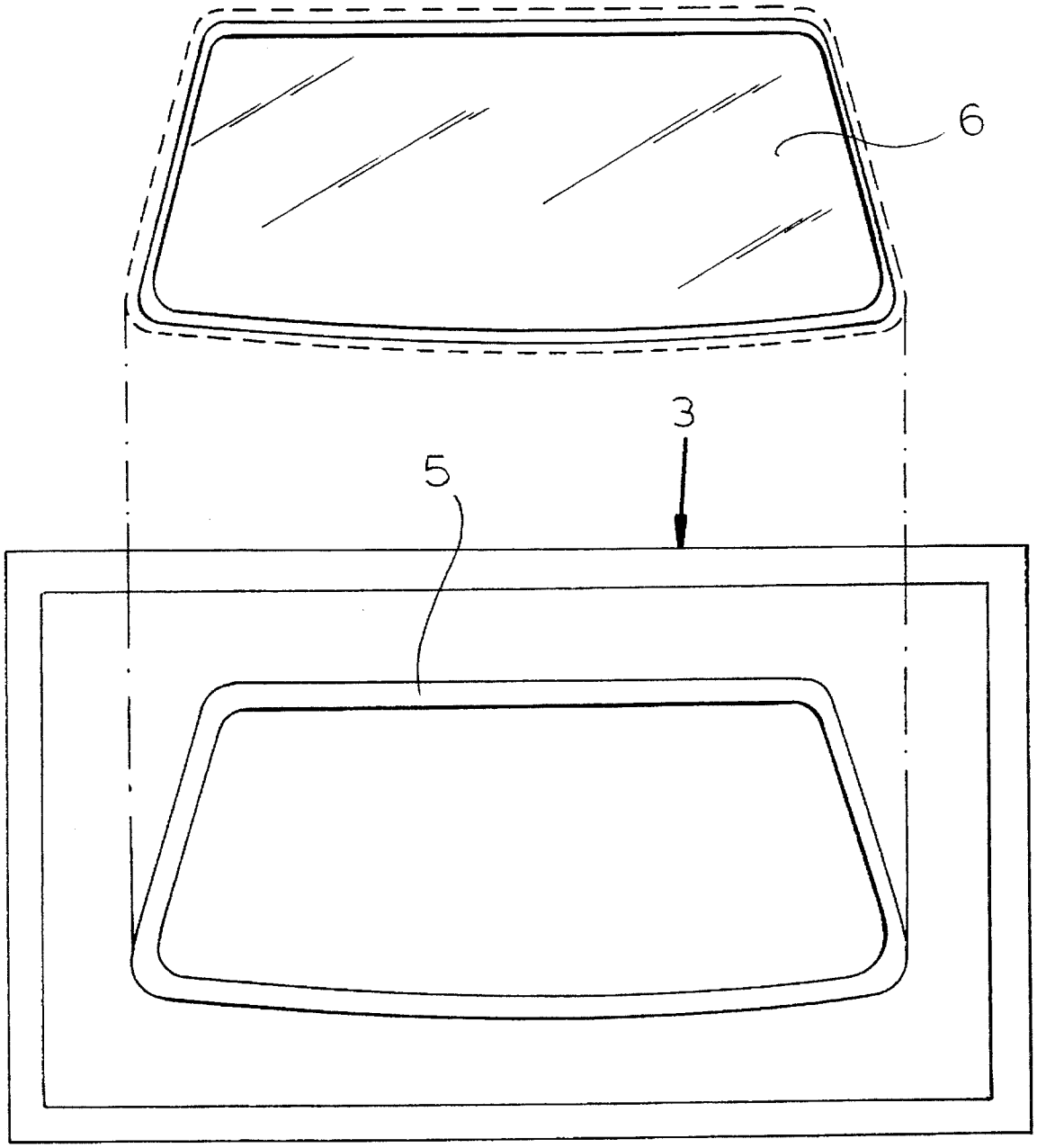
FIG. 1 is a schematic bottom plan view of the printing frame having the design to be screen printed on a vehicle window pane, shown above, where perimetrically the broken line represents the portion of design exceeding the dimensions of the pane itself.

The apparatus for screen printing from one edge to the other of a rigid material, according to the invention, comprises a printing bed 2 (FIG. 2) and a printing frame 3 (FIGS. 1 and 3) associated therewith in a per se known manner.

The printing frame 3 supports a design 5 to be screen printed, on an object made of rigid material, such as, for example, a car window pane 6.

Figure 5:
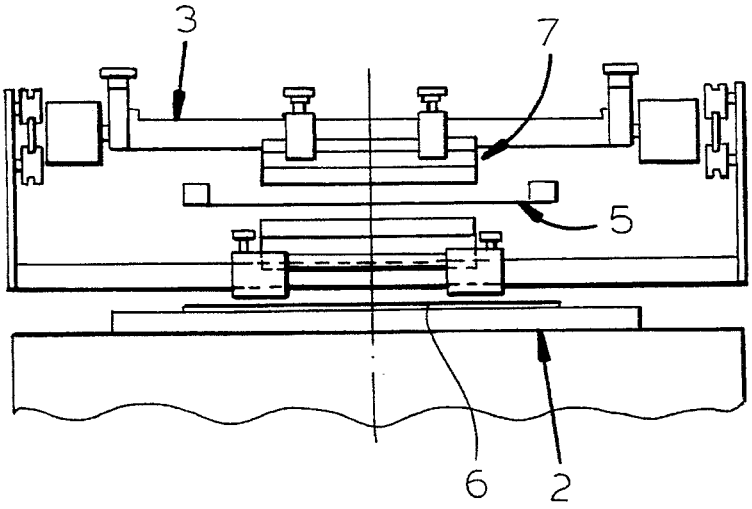
FIG. 5 is a fragmentary schematic side elevational view of the second scraping means arranged below the printing frame.

The printing frame, in a per se known manner, also comprises a means for distributing the ink on the frame, a means for pressing the ink through the design 5 and at least a first scraping means for scraping of said ink from the printing frame, partially visible in FIG. 5, and generally designated by 7.

The apparatus also comprises second scraping means, comprising at least one scraper 8, acting on the lower face of the printing frame, i.e. on the face facing the pane 6, advantageously allowing the ink to be removed from the pane and in particular from the portion of the printed design exceeding the peripheral dimensions of the pane 6.

More in detail, the scraper 8 moves along a path parallel to and below the path followed by the first scraping means, by the distributing means and by the pressing means, the path comprises a collecting area 9 of the ink which is scraped from below the printing frame.

Furthermore, for optimizing the scraping operation, below the printing frame, the axis of the scraping member 10 of the scraper 8, is inclined in order to form an angle equal to or less than 90° with the plane of the printing frame on the direction of motion.

Figure 2:
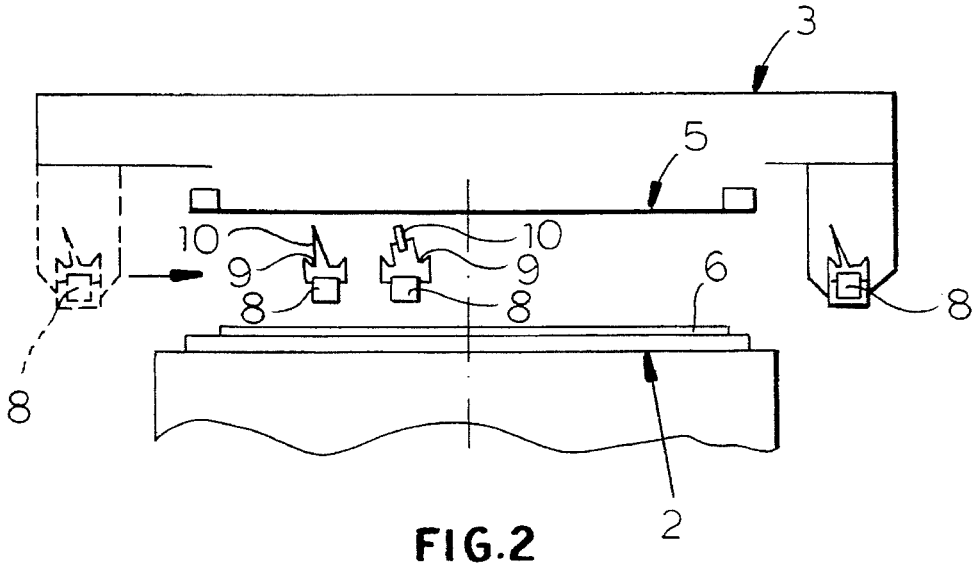
FIG. 2 is a schematic front elevational view of the arrangement of the second scraping means acting on the lower face of the printing frame according to the invention.

For example, in FIG. 2, the scraper 8 is shown in a starting position by a broken line and in an end position by a full line, on the right hand side of FIG. 2.

As an example, the scraper 8 is shown as providing a partial rotation of its scraping member 10, according to the direction of motion of the scraper, in order to provide the optimal scraping angle, according to the requirements.

Figure 3:
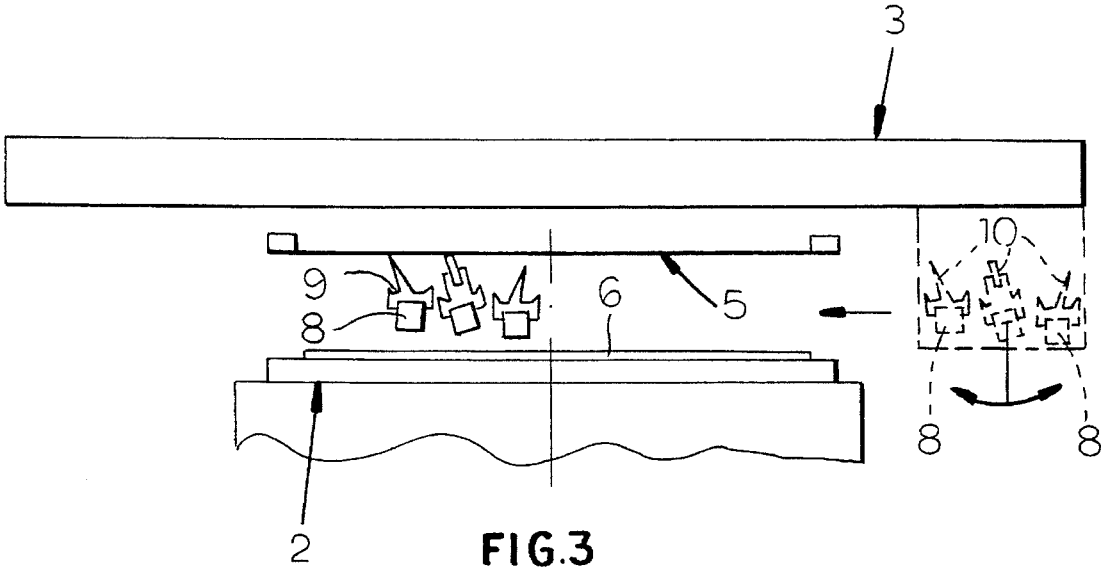
FIGS. 3 and 4 are views similar to FIG. 2 which show the different possible movements and embodiments of the second scraping means according to the invention.
Figure 4:
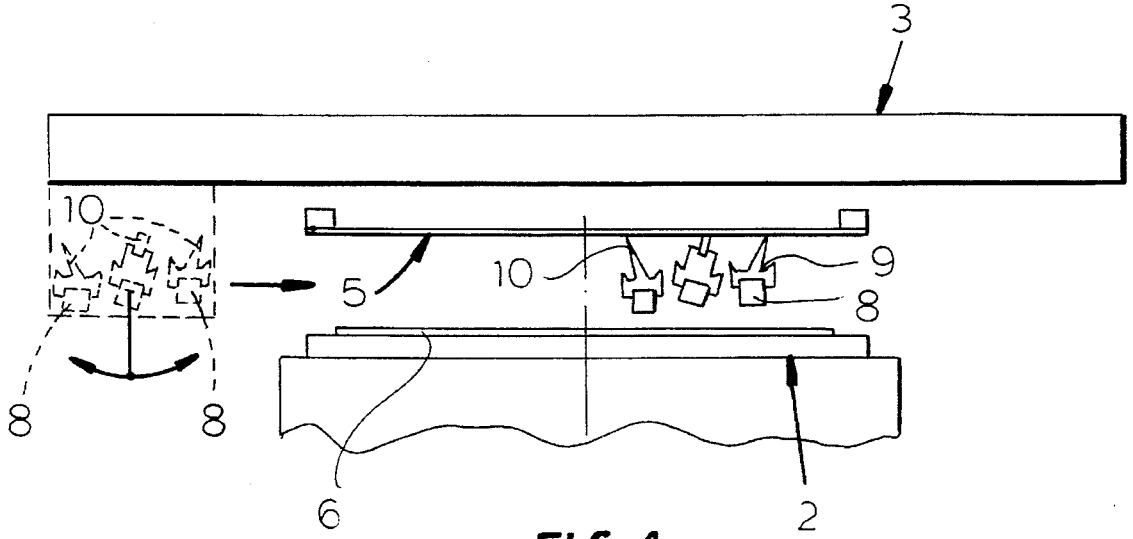

Furthermore, instead of just one scraper, which would imply an idle stroke of the scraper to return to the starting position, of course it is possible, as illustrated in FIGS. 3 and 4, to use two scrapers.

In this case, the scraper member 10 of each scraper has a counterposed inclination in order that one scraper or the other may work depending on the direction of scraping, thereby reducing the time required for the scraping operation.

Conveniently, in a preferred embodiment, instead of the collecting area 9 for the ink scraped from below the printing frame, removing means for removing the ink from the two scraping members 10 are provided outside the printing frame.

In particular, for each scraper 8, the removing means comprises a roll 20 made of absorbent material, for example sponge, which is in contact with the scraper member, the roll rotating around its axis and at the same time moving parallel to the longitudinal axis of the scraper.

In this manner the roll 20 removes and absorbs the ink from the scraper.

Figure 9:
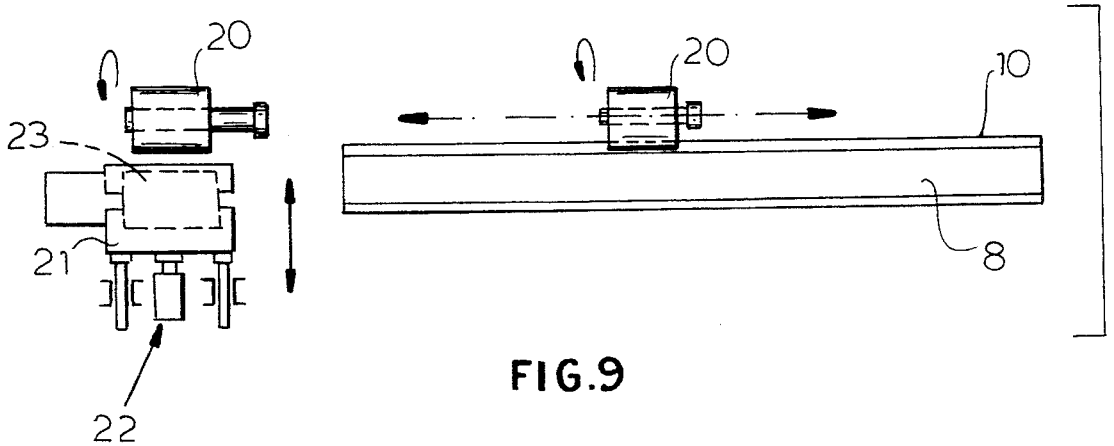
FIG. 9 is an enlarged schematic lateral elevational view of the roll made of absorbent material and of the collecting tray for the ink pressed from the roll, according to the invention.
Figure 11:
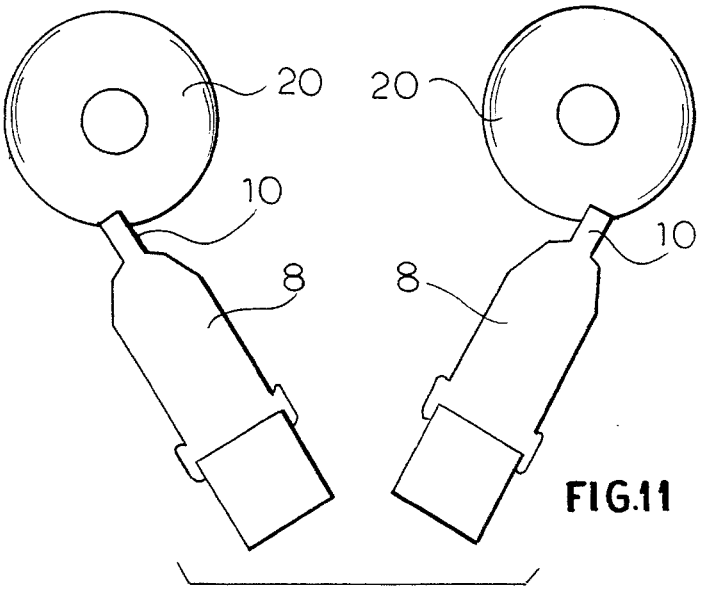
FIG. 11 is an enlarged front view exemplifying the absorbent rolls acting on the scrapers according to the invention.
Figure 10:
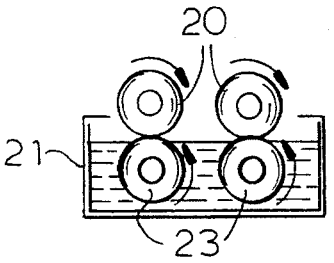
FIG. 10 is a front elevational view of the tray, shown in FIG. 9, supporting the presser members, according to the invention.

Subsequently, when the roll 20 has moved outside the printing frame (FIG. 9) a moving means 22 raises a tray 21 in order to put a presser member, for example a presser roll 23, against the roll. 20 in order to press out the ink contained in the roll 20 and collect the ink in the tray 21.

Furthermore, first cleaning means of the lower face are provided, in order to prevent any ink leftover from staining the lower face of the printing frame, with all the consequent inconveniences, during the motion of one of the scrapers. The cleaning means comprises a first feed roll 24 for feeding absorbent paper 25 to a second motorized roll 26 for winding the paper.

A pusher 27 is provided between the first and second rolls. The pusher is vertically moving with respect to the printing frame and is adapted to guide the paper in contact with the lower face of the printing frame, by means of a plurality of holes 28 arranged on the surface of the pusher for sucking air.

Figure 6:
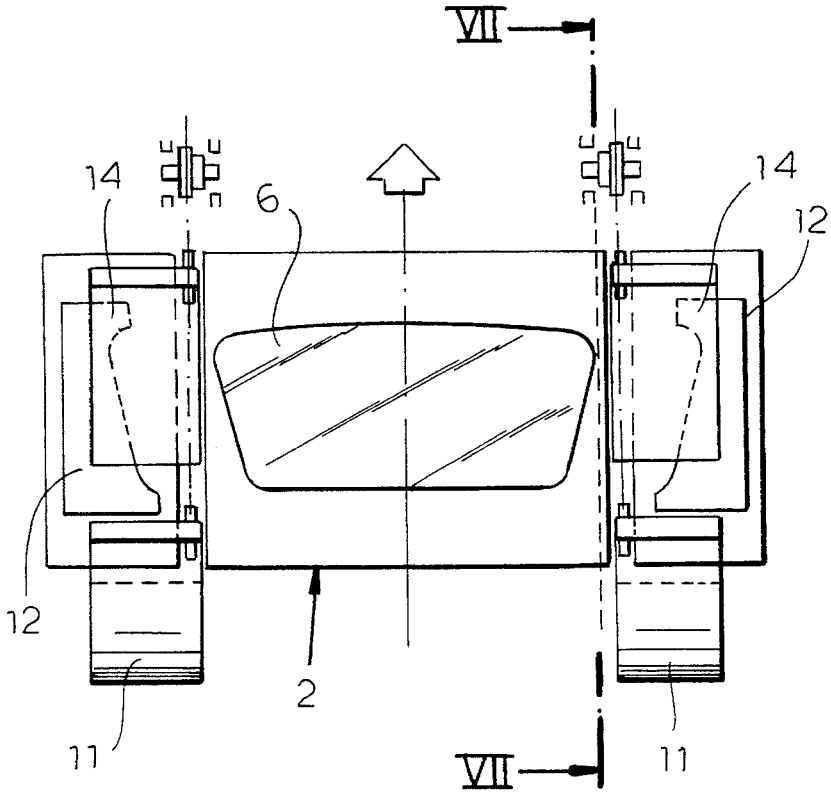
FIG. 6 is a schematic plan view of the printing bed of the apparatus and of the centering templates of, for example, a vehicle window pane, according to the invention.
Figure 7:
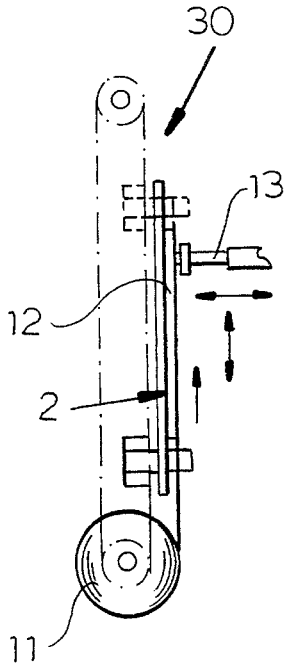
FIG. 7 is a sectional view according to the line VII—VII of FIG. 6, showing the cleaning means which can be applied to the sides of the printing bed, according to the invention, for cleaning the pane centering templates.
Figure 8:
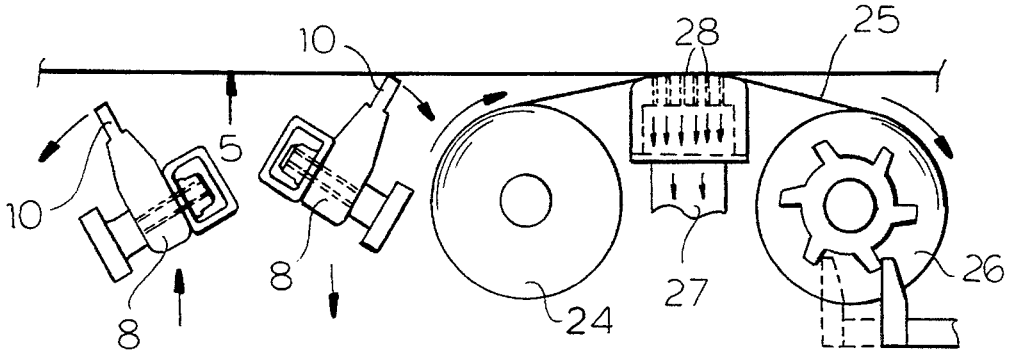
FIG. 8 is a schematic front elevational view of first cleaning means of the lower face of the printing frame, according to the invention.

In the case of the example illustrated in FIG. 6, where the glass pane is centered on the printing bed by means of templates 12, which remain in the holding position of the pane for the duration of the printing process, since the printed image is larger than the object to be printed, it may happen that some ink stains the templates and this ink has to be removed before the successive printing operation.

In this case, the apparatus is provided with second cleaning means, generally designated by the numeral 30, and comprising at least one paper roll 11. The paper roll has several easily brakable lines for allowing a piece of paper 14 to detach and be brought over the templates 12, by means of a presser 13 movable along two cartesian axes, for removing any ink possibly staining the templates.

When the templates have been cleaned, the movable presser 13 unloads the piece of paper into a collector, not illustrated, opposite the roll 11.

More particularly, the presser 13, spaced from one of the templates 12, moves to the roll 11. Then the presser 13 lowers toward the roll 11 and drags it, causing the detachment of the piece of paper over the templates and cleaning them. The piece of paper is then unloaded into the collector.

The present invention also relates to a screen printing process which is implemented by the above described apparatus.

The method for screen printing from one edge to the other of a rigid material consists of arranging a design on a printing frame 3. All the perimetric dimensions of the design are proportionally greater than the dimensions of, for example, the glass pane 6 to be printed across the edges without discontinuity.

After the glass pane 6 has been centered on a printing bed 2, the design is printed on the pane by screen printing beyond the edges of the pane 6.

Of course, the ink belonging to the area of the design which extends beyond the edges of the glass pane 6, will go over the opposite side of the printing frame and will have to be removed before the successive printing operation.

Therefore, after spacing the printing frame from the glass pane 6, ink which has not been deposited on the glass pane 6 because of the lesser dimensions of the pane with respect to the design 5 is scraped off the lower face of the printing frame facing the glass pane 6.

In this manner, a screen print has been obtained on all the edges of the glass pane 6 without discontinuity and regardless of any variation of the dimensions of the glass pane with respect to the nominal dimensions.

Conveniently, the scraping operation of the lower face of the printing frame 3 is performed when the printing frame is spaced from and parallel to the printing bed 2.

After the last scraping operation (return of the scraper or scrapers) a supplementary removal operation is performed for removing any possible ink leftovers by means of absorbent paper, as already described, or equivalent products, without lengthening the printing process.

In case the glass pane 6 is retained, as illustrated in FIG. 6, by templates, these templates may be subjected to an automatic cleaning operation of any ink which may have deposited on the templates. This cleaning operation is performed simultaneously with the scraping operation thereby obtaining a screen printing process having the same length of a conventional printing process but with the described advantages.

The invention achieves the intended aims and has important and considerable advantages.

The new process and apparatus for screen printing from one edge to the other of an object made of rigid material is effective even when the perimetric dimensions of the object have a positive or negative variation with respect to the nominal design dimensions.

Furthermore, with the process and apparatus according to the invention it is possible to screen print a rigid object independently from the standard parameters conventionally used in screen printing.

The apparatus and process for screen printing according to the invention also allow to reduce the cost of each produced item and the start up costs for modifying the existing production lines.

I claim:

1. An apparatus for screen printing a glass pane, comprising:

a printing bed provided with means for holding a glass pane to be screen printed;

a printing frame disposed above said printing bed and provided with a design for screen printing on said glass pane, said design extending beyond a perimeter of said glass pane;

means for distributing ink on said printing frame;

first scraping means above said printing frame for scraping said ink over said design and forcing said ink through said design to screen print said glass pane;

second scraping means below said frame and including at least one scraper movable in two directions for scraping ink from a lower face of said printing frame in regions beyond said perimeter;

ink removing means at said printing frame engaging with said at least one scraper for removing ink therefrom scraped by said at least one scraper off of said lower face of said frame; and wiping means for wiping said lower face with absorbent paper subsequent to removal of ink therefrom by said at least one scraper.

2. The apparatus defined in claim 1 wherein said ink removing means includes at least one absorbent roll acting on said at least one scraper and rotatable about an axis of said roll and movable parallel to an axis of said at least one scraper, at least one presser member for pressing said roll and expressing ink therefrom, a collecting tray for collecting ink expressed from said roll, and means for moving said tray at a right angle to said axis of said at least one scraper.

3. The apparatus defined in claim 1 wherein said wiping means includes a first feed roll for feeding said absorbent paper, a second motorized roll winding up said absorbent paper, and a pusher between said first and second rolls, said pusher being vertically movable relative to said printing frame for placing said paper in contact with said lower face of said printing frame.

4. The apparatus defined in claim 3 wherein said pusher is provided with a plurality of holes on its surface and comprises means for drawing air through said holes for gripping and guiding said paper.

5. The apparatus defined in claim 1, wherein said means for holding comprises centering templates for positioning said glass pane on said printing bed, and means for cleaning said templates.

6. The apparatus defined in claim 5 wherein said means for cleaning said templates includes a roll of absorbent paper having break lines, a presser movable along two directions of a Cartesian system for detaching a piece of paper from said roll, and for moving said piece of paper into contact with said centering templates for cleaning said templates and thereafter discarding said piece.

7. A method of screen printing a glass pane, comprising the steps of:

(a) centering a glass pane to be screen printed on a printing bed;

(b) providing above said glass pane to be screen printed a printing frame formed with a design for screen printing on said glass pane, said design extending beyond a perimeter of said glass pane;

(c) distributing ink on said printing frame;

(d) scraping ink on said printing frame over said design and forcing said ink through said design to screen print said glass pane whereby ink is disposed along a lower surface of said printing frame beyond the perimeter of said glass pane;

(e) scraping the ink from said lower surface of said printing frame with at last one scraper movable in two directions to remove said ink beyond said perimeter on said lower surface onto said scraper;

(f) removing ink from said scraper by rotating an absorbent roll thereagainst and moving said roll along said scraper; and (g) thereafter wiping said lower surface with absorbent paper.

* * * * *